US008909088B2

(12) United States Patent
Murooka

(10) Patent No.: US 8,909,088 B2
(45) Date of Patent: Dec. 9, 2014

(54) FIXING APPARATUS AND IMAGE FORMING APPARATUS EQUIPPED WITH AN AIR DUCT FOR GUIDING AIR

(75) Inventor: Ken Murooka, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 164 days.

(21) Appl. No.: 13/527,872

(22) Filed: Jun. 20, 2012

(65) Prior Publication Data

US 2012/0328323 A1 Dec. 27, 2012

(30) Foreign Application Priority Data

Jun. 22, 2011 (JP) ..... 2011-138597

(51) Int. Cl.
*G03G 21/20* (2006.01)
*G03G 15/20* (2006.01)

(52) U.S. Cl.
CPC ..... *G03G 15/2017* (2013.01); *G03G 15/2042* (2013.01)
USPC ..... 399/92

(58) Field of Classification Search
CPC G03G 15/2017; G03G 15/2042; G03G 21/20
USPC ..... 399/92, 406
See application file for complete search history.

(56) References Cited

U.S. PATENT DOCUMENTS

| | | | | |
|---|---|---|---|---|
| 6,259,871 | B1 * | 7/2001 | Rider et al. | 399/92 |
| 7,194,221 | B2 * | 3/2007 | Kim et al. | 399/92 |
| 7,206,533 | B2 * | 4/2007 | Kwon | 399/92 |
| 8,139,973 | B2 * | 3/2012 | Ishikawa et al. | 399/92 |
| 8,554,104 | B2 * | 10/2013 | Shimoyama et al. | 399/92 |

FOREIGN PATENT DOCUMENTS

| | | |
|---|---|---|
| JP | 2008-32903 A | 2/2008 |
| JP | 2008-116858 A | 5/2008 |

* cited by examiner

*Primary Examiner* — Susan Lee
(74) *Attorney, Agent, or Firm* — Canon USA Inc IP Division

(57) ABSTRACT

In a fixing unit in which a recording material carrying a toner image is heated while conveying in a nip portion to fix the toner image onto the recording material, a measure to prevent both of temperature rise at non-sheet-passing area and condensation slippage using at least one air supplying unit is required. Separately providing air supplying units for these two issues results in the need of a plurality of fans only for the fixing unit, increasing the size and cost of the apparatus. Thus, decreases in size and cost of a fixing unit and an image forming apparatus including the fixing unit can be achieved by using a common air supplying member to prevent both of temperature rise at non-sheet-passing area and condensation slippage.

16 Claims, 12 Drawing Sheets

(STATE WITH SHUTTERS CLOSED)

(STATE WITH SHUTTERS OPEN)

FIXING APPARATUS AND IMAGE FORMING APPARATUS EQUIPPED WITH AN AIR DUCT FOR GUIDING AIR

BACKGROUND OF THE INVENTION

1. Field of the Invention

The present disclosure relates to a fixing apparatus for fixing a toner image onto a recording material, and an image forming apparatus that is equipped with the fixing apparatus and utilize an electrophotographic method or an electrostatic recording method, such as a printer, a copying machine, a facsimile, a multifunction peripheral, or the like.

2. Description of the Related Art

In such an image forming apparatus, an image forming unit forms a unfixed toner image onto a sheet of a recording material (hereinafter, also referred to as paper), and then a fixing unit (fixing apparatus) fixes the toner image as a fixed image.

As for the fixing unit, various types have been discussed. Among those, in recent years, an environmentally-friendly power-saving fixing type has been increasingly in demand. Currently, a heating-type fixing unit has been in practical use. In an image forming apparatus, such a heating-type fixing unit uses a heating member having a low heat capacity such as a ceramic heater, a belt having a low heat capacity, and a pressure roller that pressurizes and drives the belt, so that the image forming apparatus at low temperature can be rapidly heated.

However, in the apparatus having the heating-type fixing unit, when small size sheets pass there through continuously, a surface of an area through which sheets do not pass (i.e., a non-sheet-passing area) of the belt is heated to an excessively high temperature. This is because, during the continuous passing of small size sheets, the non-sheet-passing area where the recording materials do not pass continues to receive heat without removal by the recording materials.

The phenomenon is called edge temperature rise at a fixing unit or temperature rise at non-sheet-passing area. An excess edge temperature rise may result in hot offset or heat damage of members of the apparatus.

In addition, at the start of continuous printing after warming-up of the apparatus from low temperature by the fixing unit, water vapor is given off from sheets that pass the fixing unit, which may lead to occurrence of condensation at a pressure roller that has not reached a temperature greater than its dew point. The condensation at the pressure roller decreases friction between the pressure roller and a belt facing thereto. The decreased friction may cause an issue of slippage between the pressure roller and the belt (hereinafter, referred to as condensation slippage).

Among the above issues, as for the temperature rise at non-sheet-passing area, Japanese Patent Application Laid-Open No. 2008-32903 discusses a resolution. The resolution uses a cooling fan that supplies cooling air toward a non-sheet-passing area, while avoiding temperature rise at the non-sheet-passing area by adjusting the length of an air outlet port of the fan in its width direction, according to the width of a recording material to be used. As for the condensation slippage, Japanese Patent Application Laid-Open No. 2008-116858 discusses a technique for using a fan disposed below a fixing apparatus to avoid condensation. The fan operates as a pressure roller operates, so that any condensation in the fixing apparatus can be avoided.

These structures for avoiding temperature rise at a non-sheet-passing area and condensation slippage, however, require a plurality of fans only for a single fixing unit. The increase in the number of the fans swells the number of power sources, electric circuits, control circuits, fan ducts, and covers to be used, according to the number of the fans. The increase in the total number of the components may increase costs and sizes of a fixing unit and an image forming apparatus equipped with the fixing unit.

In recent years, such a fixing unit and an image forming apparatus equipped with the fixing unit have been demanded to have characteristics of power saving, print productivity (e.g., time saving in printing of one sheet), down-sizing of apparatus body, and low cost. To meet the demand to the maximum extent, decrease in the number of fans is an essential key.

SUMMARY OF THE INVENTION

The present disclosure relates to achieving decreases in size and cost of a fixing unit and an image forming apparatus equipped with the fixing unit by using a common member as a non-sheet-passing area cooling fan to avoid temperature rise at non-sheet-passing areas and as an air supplying member to avoid condensation slippage.

According to an aspect of the present disclosure, an image forming apparatus for forming a toner image onto a recording material, and conveying and heating the recording material in a nip portion to fix the toner image on the recording material includes an image forming unit configured to form a toner image onto a recording material, a fixing unit including a heating member and a pressure member that forms the nip portion with the heating member, an air supplying fan configured to cool an end portion of the heating member located in a direction perpendicular to a conveyance direction of the recording material, and a shutter disposed between the air supplying fan and the heating member, wherein the image forming apparatus includes an air duct for guiding air from the air supplying fan to the pressure member.

According to another aspect of the present disclosure, a fixing apparatus for conveying and heating a recording material carrying a toner image in a nip portion to fix the toner image onto the recording material includes a heating member, a pressure member configured to form the nip portion with the heating member, an air supplying fan configured to cool an end portion of the heating member located in a direction perpendicular to a conveyance direction of the recording material, and a shutter disposed between the air supplying fan and the heating member, wherein the fixing apparatus includes an air duct for guiding air from the air supplying fan to the pressure member.

The present disclosure enables shared use of an air supplying fan to avoid temperature rise at non-sheet-passing areas and to avoid condensation slippage, thereby achieving decreases in size and cost of a fixing unit and an image forming apparatus equipped with the fixing unit.

Further features and aspects will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, together with the description, serve to explain the principles disclosed herein.

DESCRIPTION OF THE EMBODIMENTS

Various exemplary embodiments, features, and aspects will be described in detail below with reference to the drawings.

(1) Image Forming Apparatus

Figure 1:
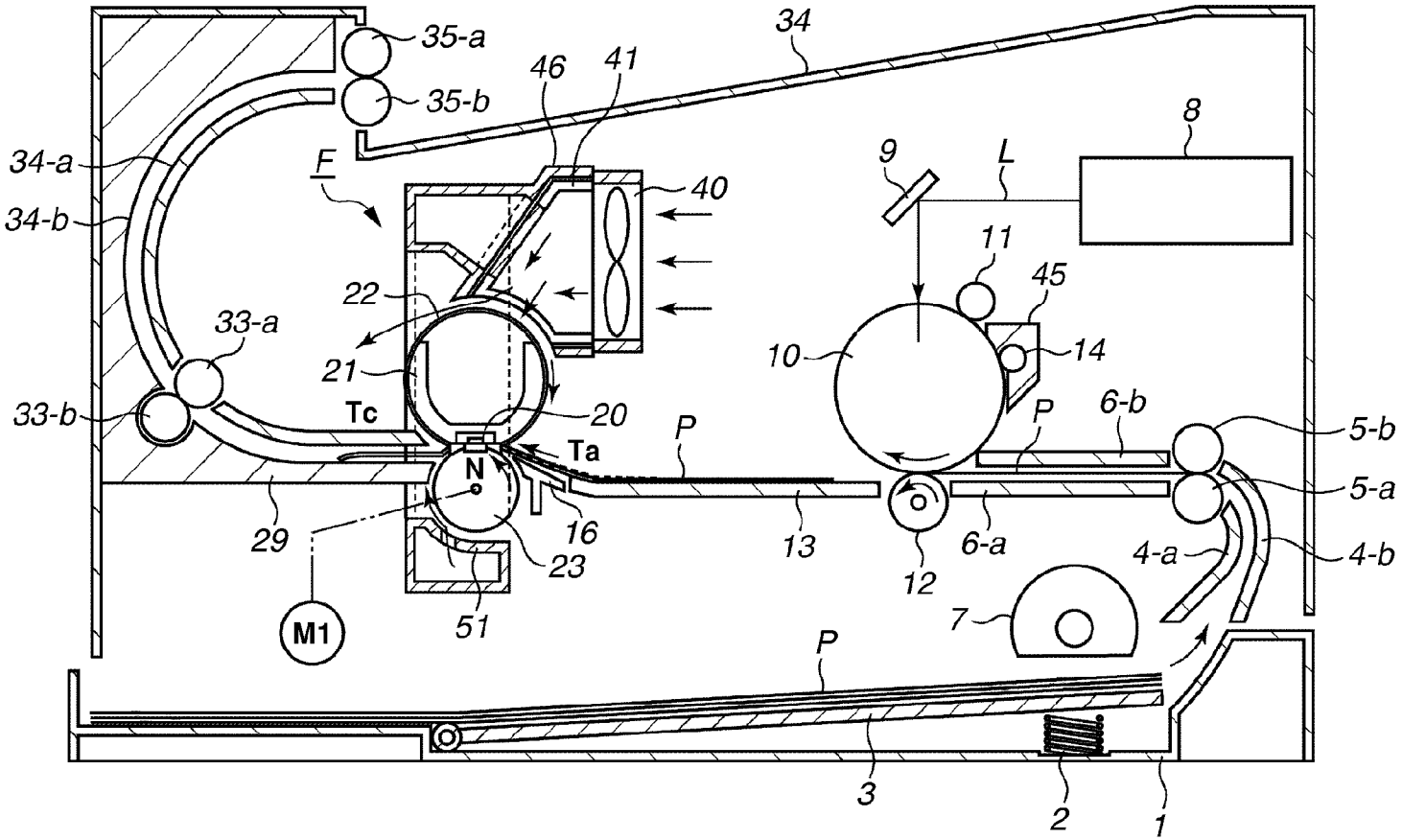
FIG. 1 is a schematic cross sectional view illustrating an image forming apparatus according to an exemplary embodiment.

An image forming apparatus equipped with a fixing unit (fixing apparatus) according to the present exemplary embodiment is described. FIG. 1 is a schematic cross sectional view illustrating the image forming apparatus according to the present exemplary embodiment.

The image forming apparatus includes a photosensitive drum 10 as an image bearing member. The photosensitive drum 10 is rotationally driven by an apparatus-body driving motor (not illustrated) serving as a driving unit, to rotate at a predetermined process speed in the direction indicated by an arrow. The image forming apparatus herein is driven at a process speed of 250 mm/sec.

Around the photosensitive drum 10, a charging roller 11 as a charging apparatus, an exposure apparatus 8, a development apparatus 14, and a transfer roller 12 as a transfer apparatus are disposed in sequence. These components and the photosensitive drum 10 constitute an image forming unit to form images on recording materials.

In the lower part of the apparatus body, a sheet feeding cassette 1 is disposed with recording materials P (e.g., papers, printing sheets, sheets, overhead transparency (OHT) sheets, glossy sheets, and glossy films) therein. Along a conveyance path of the recording material P, a feed roller 7, conveyance rollers 5, the photosensitive drum 10 and the transfer roller 12, conveyance guides 4, 6, and 13, a fixing unit F, discharge rollers 35, and a discharge tray 34 are disposed in sequence.

Operations of the image forming apparatus including the above structure are described. The photosensitive drum 1 rotationally driven by the apparatus-body driving motor (not illustrated) in the direction indicated by the arrow is uniformly charged by the charging roller 2 to a predetermined polarity and a predetermined potential. The exposure apparatus 8 is a laser scanner, and outputs a laser beam corresponding to an image information signal input from a host apparatus, such as a computer and an image reading apparatus (not illustrated), so that a surface area of the photosensitive drum 10 is scanned and exposed with the laser beam which travels via a folding mirror 9 (not illustrated). The exposed area of the photosensitive drum 10 thus loses its charge, where an electrostatic latent image is formed. The electrostatic latent image is developed by the development apparatus 14. The development apparatus 14 including a developing roller applies a developing bias to the developing roller, which causes toner to adhere to the electrostatic latent image formed on the photosensitive drum 10, so that the image is developed (visualized) as a toner image. The toner image on the photosensitive drum 10 is transferred to the recording material P by the transfer roller 12.

The recording materials P are fed from the sheet feeding cassette 1 by the feed roller 7 one by one and conveyed by the conveyance rollers 5 toward a transfer nip portion provided between the photosensitive drum 10 and the transfer roller 12. The recording material P then is detected at its leading end by a top sensor (not illustrated), and is synchronized with the toner image on the photosensitive drum. Upon application of a transfer bias to the transfer roller 12, the toner image on the photosensitive drum 10 is transferred to a predetermined position on the recording material P.

After the transfer, the recording material P carrying the unfixed toner image on its surface is conveyed along the conveyance guide 12 to a fixing inlet guide 16, and is guided to the fixing unit F. The unfixed toner image is heated and pressurized at the fixing unit F to be fixed onto the recording material P. The recording material P having the fixed toner image thereon is conveyed along a discharge and separation guide 29 to separation guide rollers 33 to be discharged from the discharge rollers 35 to the discharge tray 34 disposed on the upper surface of the apparatus body.

The above operations are repeated for continuous image formation.

(2) Fixing Unit F

In the following description, the term "longitudinal direction" of the fixing unit or members constituting the fixing unit refer to a direction perpendicular to a conveyance direction of the recording material in a plane of the conveyance path of the recording material. With respect to the fixing unit, the term "front side" refers to the plane in which a recording material is introduced, and the term "right/left side" refers to the plane on the right or left side of the front side when seen from the front side. A width of a recording material refers to a dimension of a surface of the recording material in a direction perpendicular to the conveyance direction of the recording material.

Figure 2:
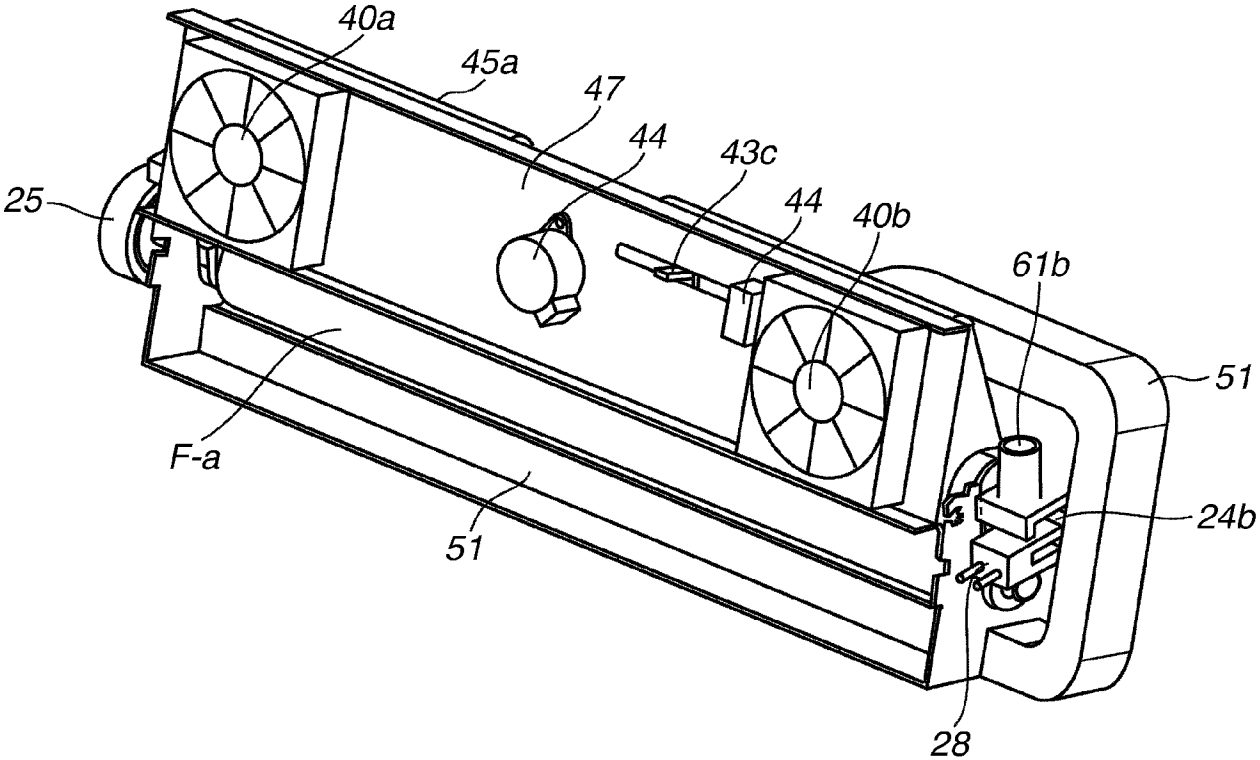
FIG. 2 is a perspective view illustrating a fixing apparatus including air supplying members according to the exemplary embodiment.
Figure 3:
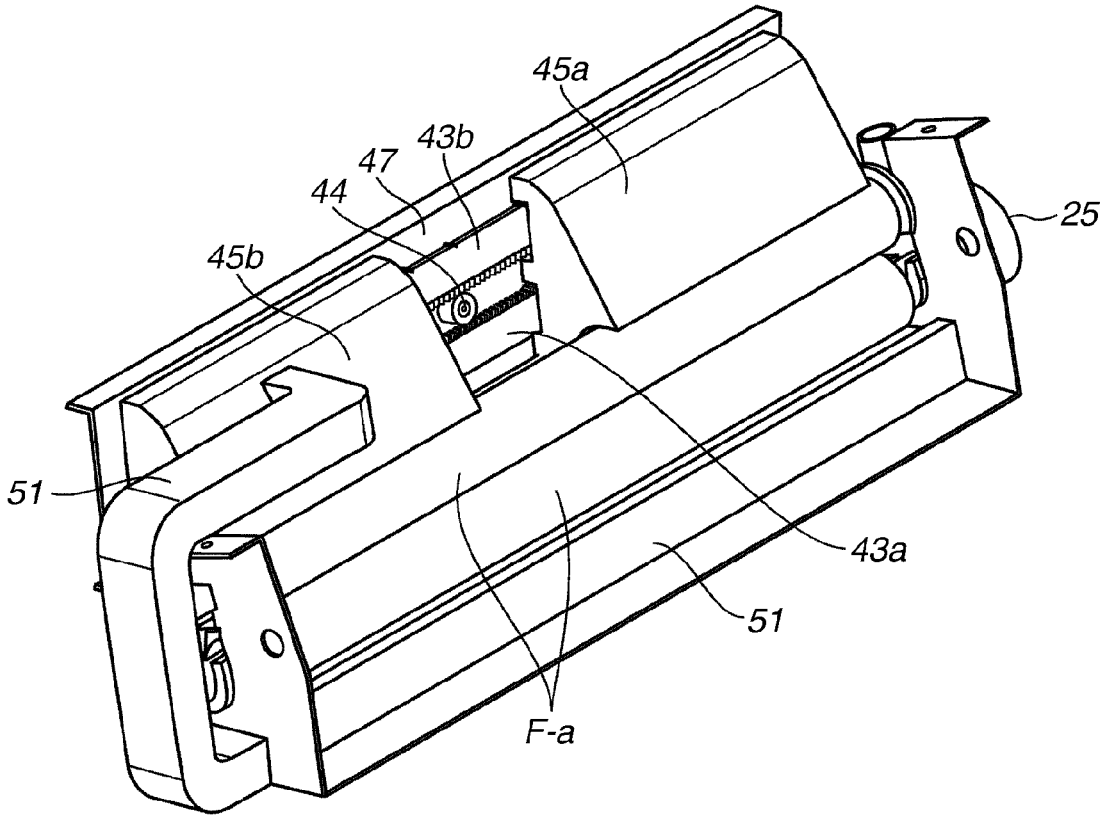
FIG. 3 is another perspective view illustrating a fixing apparatus including air supplying members according to the exemplary embodiment.
Figure 4:
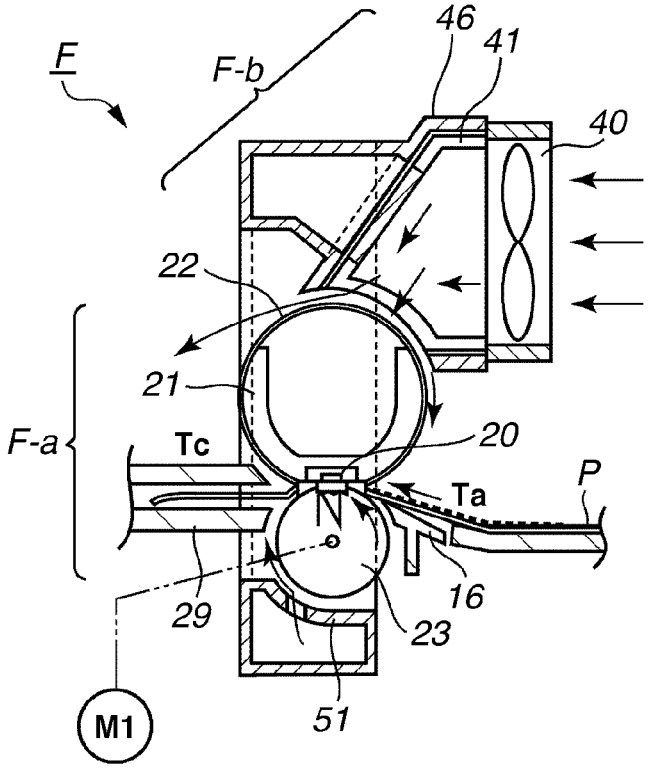
FIG. 4 is a schematic cross sectional view illustrating a fixing unit.

FIGS. 2 and 3 illustrate an appearance perspective view of the fixing unit F as seen from different viewpoints respectively. FIG. 4 is a cross sectional view of the fixing apparatus F. The fixing unit F is generally comprised of a fixing unit (fixing device) F-a using a belt heating system, and an air supplying unit F-b.

(2-1) Fixing Unit F-a

Figure 5:
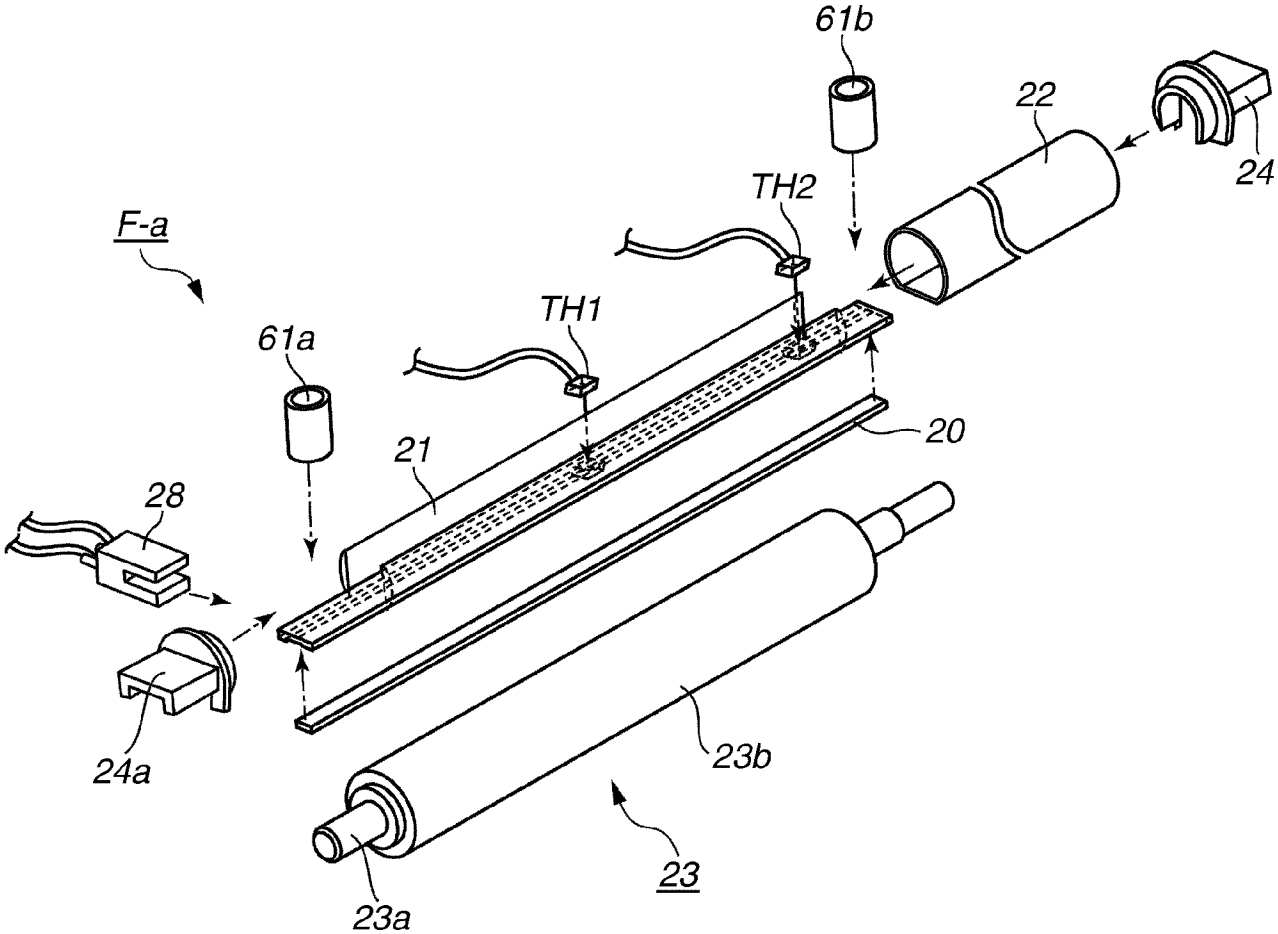
FIG. 5 is an exploded perspective view illustrating the fixing unit.

With reference to FIGS. 4 and 5, a structure of the fixing unit F-a is described. FIG. 5 is an exploded perspective view of the fixing unit F-a.

The fixing unit F-a is an on-demand fixing apparatus using a belt heating system and a pressure rotator driving system.

The fixing unit F-a includes a fixing belt 22, and a pressure roller 23 as a pressure member. The fixing belt 22 is held in pressure contact with the pressure roller 23, which forms a fixing nip portion N.

A fixing stay (which serves as a heater supporting member and a fixing belt guide member) 21 is heat-stable and rigid, and is of a trough shape having an approximately semicircular cross unit. A ceramic heater (hereinafter, abbreviated to as heater) 20 as a heating member is fixedly fit into a concave groove portion provided along the longitudinal outer surface of the fixing stay 21. The fixing belt 22 is loosely fit around the fixing stay 21 including the heater 20 therein. Flanges 24*a* and 24*b* are respectively fit to outwardly projecting arm portions at both ends of the fixing stay 21.

The fixing belt 22 is a tubular and composite laminated structure including a heat-stable resin belt or a metallic belt as a base layer and an elastic layer and a toner parting layer covering an outer circumferential surface of the base layer. The fixing belt 22 is overall thin and flexible, and has a high heat conductivity and a low heat capacity.

The ceramic heater 20 is a thin and strip-shaped heating member having a low heat capacity that has a longer dimension in the direction perpendicular to the conveyance direction of the fixing belt 22 and the recording material P. The ceramic heater 20 is basically comprised of a heater substrate made of a ceramic such as aluminum nitride and aluminum, and a conductive heat generating layer such as silver-palladium coating formed over the heater substrate. The ceramic heater 20 according to the present exemplary embodiment includes two heat generating members. The heat generating members each have a resistance value distribution varying in their longitudinal direction, and have different resistances at the central portion and at the end portions. Thus, the heat generation by the two heat generating members can be controlled to some degree through independent control of the conduction ratio of the two heat generating members according to the dimension in the width direction of the recording material passing through the fixing unit.

In other words, when a recording material has a width located in the direction perpendicular to the conveyance direction of the recording material that is the maximum one to pass through the apparatus (hereinafter, referred to as, maximum-width recording material), and the material passes through the fixing unit, the entire heat generating layer generates heat uniformly. In contrast, a recording material having a smaller width than that of the maximum-width recording material passes through the fixing unit, the heat generating layer can generate heat such that an amount of heat at its ends is lower than that at its central portion by 20 to 40%.

The pressure roller 23 as a pressure member is comprised of a core bar 23*a* and an elastic layer 23*b* such as silicone rubber that covers the core bar 23*a* to decrease the hardness of the roller 23. To provide improved surface quality, a layer of fluorocarbon resin such as polytetrafluoroethylene (PTFE), tetrafluoroethylene-perfluoroalkyl vinyl ether copolymer (PFA), or fluorinated ethylene propylene copolymer (FEP) may be formed on the outer periphery of the elastic layer 23*b*. The pressure roller 23 is rotatably supported, at its ends located in the direction perpendicular to the conveyance direction of the recording material, between side plates of an apparatus frame (not illustrated) via bearing members (not illustrated).

The fixing belt 22 is installed in parallel with the pressure roller 23 by facing the heater 20 side thereof to the pressure roller 23. The flanges 24 at the ends located in the direction perpendicular to the conveyance direction of the recording material are biased toward the axial direction of the pressure roller 23 by applying a predetermined force F through pressure mechanisms on the right and left sides. The pressure mechanisms are respectively composed of pressure springs 61*a* and 61*b* made of stainless steel compression coil springs. As a result, a surface of the heater 20 is brought into pressure contact with the pressure roller 23 through the fixing belt 22 against the elasticity of the elastic layer 32*b*, which provides the fixing nip portion N used for heating and fixing of images. An inlet guide 16 and an exit guide 29 are integrally formed with the apparatus frame (not illustrated).

A pressure roller gear 25 is fixedly secured to the left end of the core bar 32*a* of the pressure roller 23. When rotational force of a fixing motor M1 is transmitted to the pressure roller gear 25 via a driving force transmission mechanism (not illustrated), the pressure roller 23 is rotationally driven to a clockwise direction indicated by an arrow in FIG. 4. The rotation of the pressure roller 23 causes frictional force in the fixing nip portion N between the pressure roller 23 and the outer surface of the fixing belt 22, resulting in rotational force of the fixing belt 22. Consequently, the fixing belt 22 slides with its inner surface being in contact with the heater 20 in the fixing nip portion N, while rotating around the fixing stay 21 to a clockwise direction as indicated by the arrow. The fixing belt 22 rotates at a circumferential velocity approximately corresponding to that of the pressure roller 23.

The flanges 24 receive the left or right end of the belt 22 when the rotating fixing belt 22 moves toward the left or right side thereof along the longitudinal direction of the fixing stay 21 and limit the movement of the fixing belt 22. A lubricant is applied to the inner surface of the fixing belt 22 to make the fixing belt 22 slide relative to the heater 20 and the fixing stay 21.

The recording materials P are, when guided by the inlet guide 16 and entered into the fixing nip portion N, individually sandwiched and conveyed between the pressure roller 23 and the fixing belt 22 which are rotating. According to the present exemplary embodiment, the recording materials Pare conveyed with their center in the direction perpendicular to the conveyance direction thereof being aligned with the center of the fixing belt 22. In other words, the recording materials P are conveyed in a center alignment conveyance method. More specifically, the recording materials P of every size that the apparatus can handle pass through the fixing belt 22 with their center in their width direction being aligned with the center point of the fixing belt 22 in its longitudinal direction. In FIG. 6 to FIG. 9, the line S is a reference line (virtual line) for center alignment of the recording materials P.

In FIG. 5, a main thermistor TH1 and a substrate thermistor TH2 operate respectively as a first temperature detection member and a second temperature detection member. The main thermistor TH1 is disposed in contact with the rear surface of the heater 20 at the approximately central portion of the heater 20 in its longitudinal direction where the recording materials P of every size that can pass through the apparatus inevitably pass. The sub thermistor TH2 is disposed in contact with the heater 20 at a position corresponding to a non-sheet-passing area that exists when a recording material passes through the apparatus, the recording material having a width in the direction perpendicular to the conveyance direction of the recording material that is less than a predetermined value.

The heater 20 is rapidly heated over the full width area that is able to generate heat along its longitudinal direction, when supplied with power from a heater drive circuit as a power supply unit to the conductive heat generating layer at the heater substrate thereof. The elevated temperature of the heater 20 is detected by the main thermistor TH1, and the electrical information of the heater temperature is input to a control circuit unit via an analog-to-digital (A/D) converter (not illustrated). The sub thermistor TH2 detects a temperature of the fixing belt 22, and the electrical information of the temperature of the fixing belt 22 is input to the control circuit unit via the A/D converter.

The control circuit unit determines how to control the temperature of the fixing heater 20 based on the output from the main thermistor TH1 and the sub thermistor TH2, and controls power supply from the heater drive circuit to the fixing heater 20.

The control circuit unit controls the fixing motor driving circuit and drives the fixing motor M1, based on a print signal or other signals from an external host apparatus. Accordingly, the pressure roller 23 is rotationally driven, which rotates the fixing belt 22. The control circuit unit also controls the heater drive circuit, and starts heating-up of the heater 20. When the rotational speed of the fixing belt 22 becomes stable and the temperature of the heater 20 reaches a predetermined value, the recording materials P carrying unfixed toner images Ta are individually entered from the image forming unit side to the fixing nip portion N along the inlet guide 16.

The recording materials P are brought into contact with the fixing belt 22 at their surfaces carrying toner images. The recording materials P move and pass through the fixing nip portion N together with the fixing belt 22, while being close to the heater 20 via the fixing belt 22 in the fixing nip portion N. During the moving and passing, the fixing belt 22 heated by the heater 20 applies heat to the recording materials P, and a fixing nip pressure causes toner images Tc to be fixed onto the surfaces of the recording materials P respectively. The recording materials P, after passing through the fixing nip portion N, are separated from the fixing belt 22 and conveyed to be discharged.

(2-2) Air Supplying Unit F-b

The air supplying unit F-b serves as a cooling mechanism that cools a non-sheet-passing area of the fixing unit F-a by sending air when the non-sheet-passing area is heated, and as an air supplying mechanism including a duct that sends air to the pressure roller 23 to prevent slippage between the pressure roller 23 and the belt 22 due to vapor generated from sheets.

FIGS. 2 and 3 are appearance perspective view of an air supplying and cooling unit F-b as seen from different viewpoints. FIGS. 2 and 3 also illustrate the above-described fixing device F-a.

Figure 6:
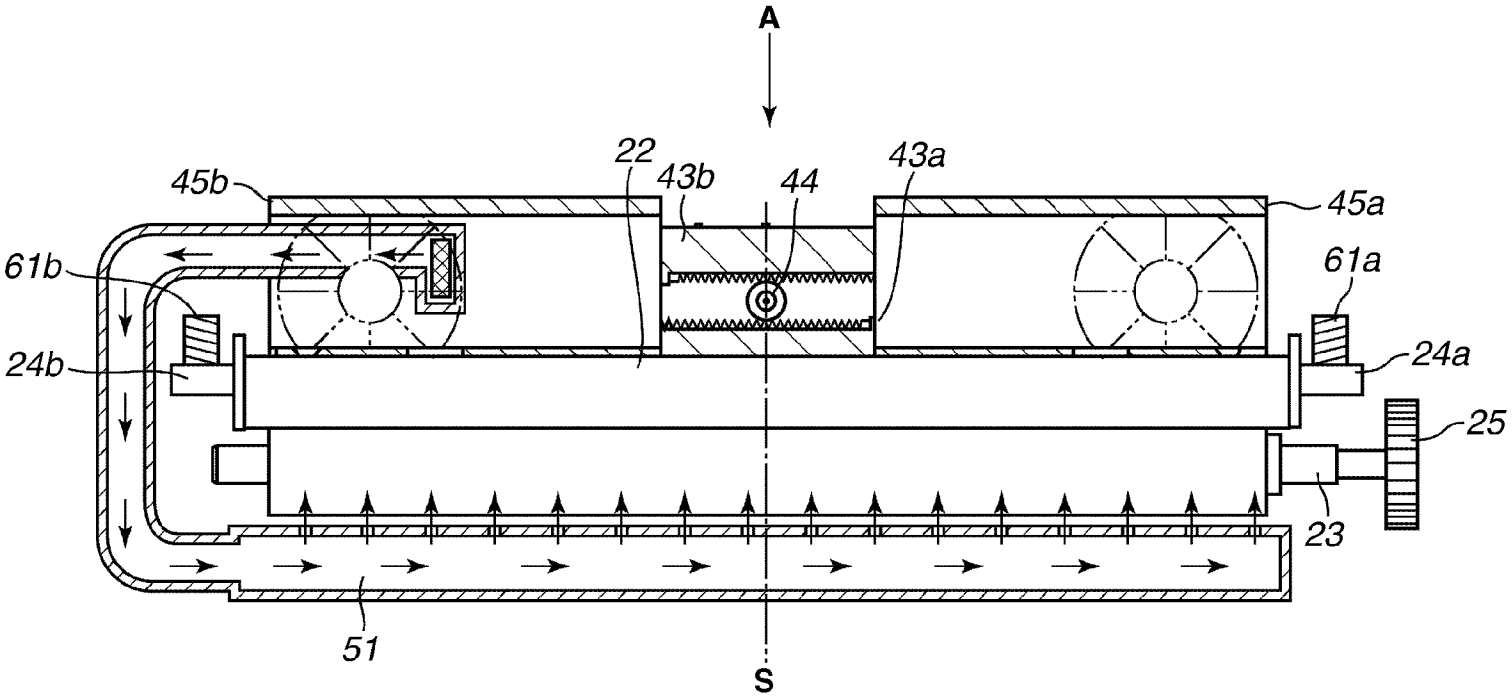
FIG. 6 is a partial cross sectional view illustrating air supplying members and the fixing unit.
Figure 7:
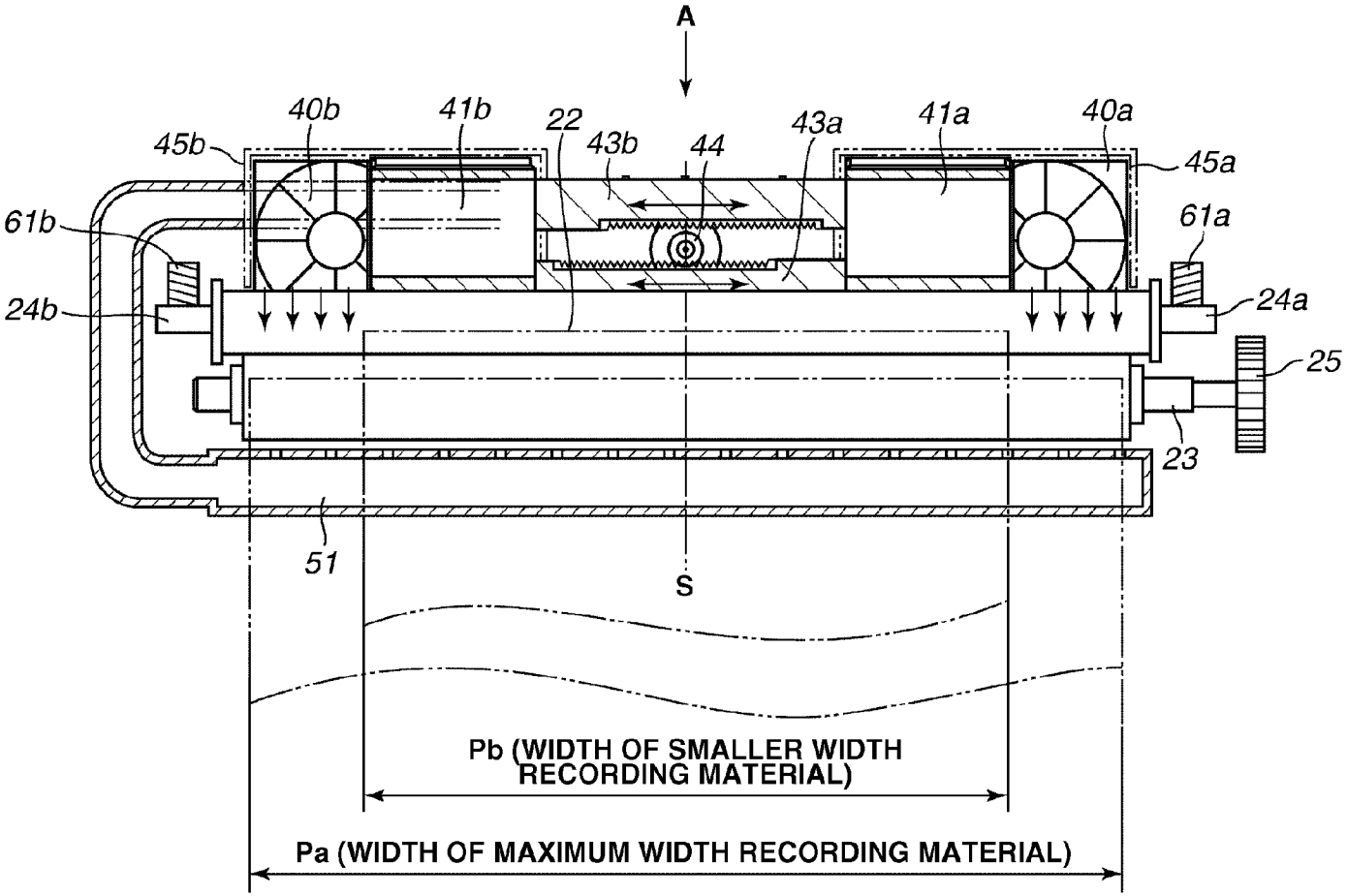
FIG. 7 is another partial cross sectional view illustrating air supplying members and the fixing unit.
Figure 8:
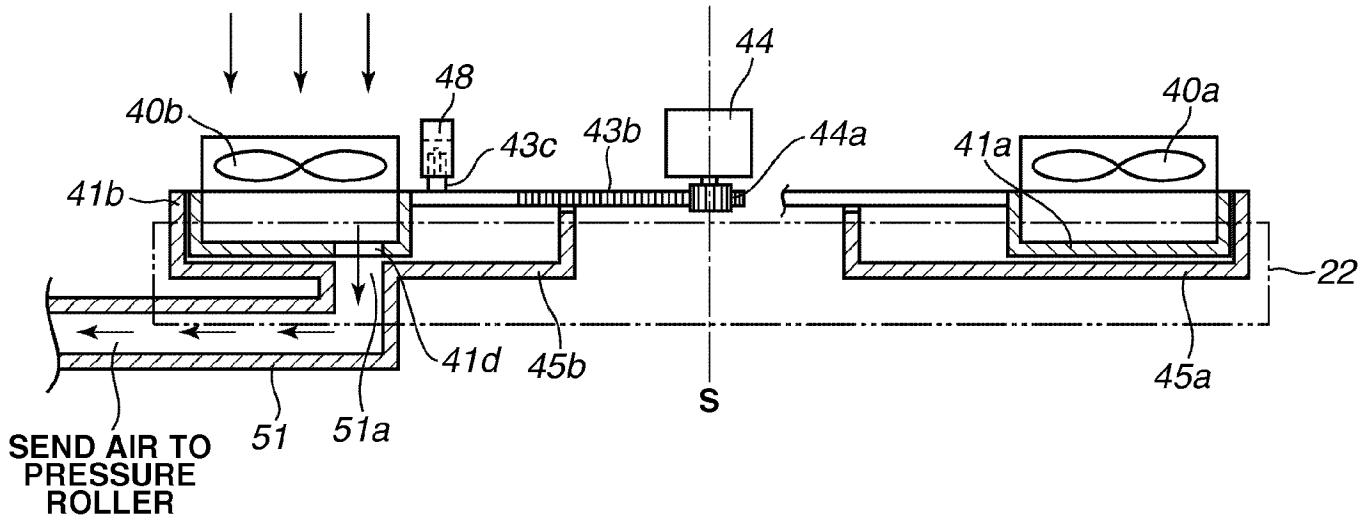
FIG. 8 is a schematic cross sectional view illustrating an operation of shutters, when the shutters are closed, according to the exemplary embodiment.
Figure 9:
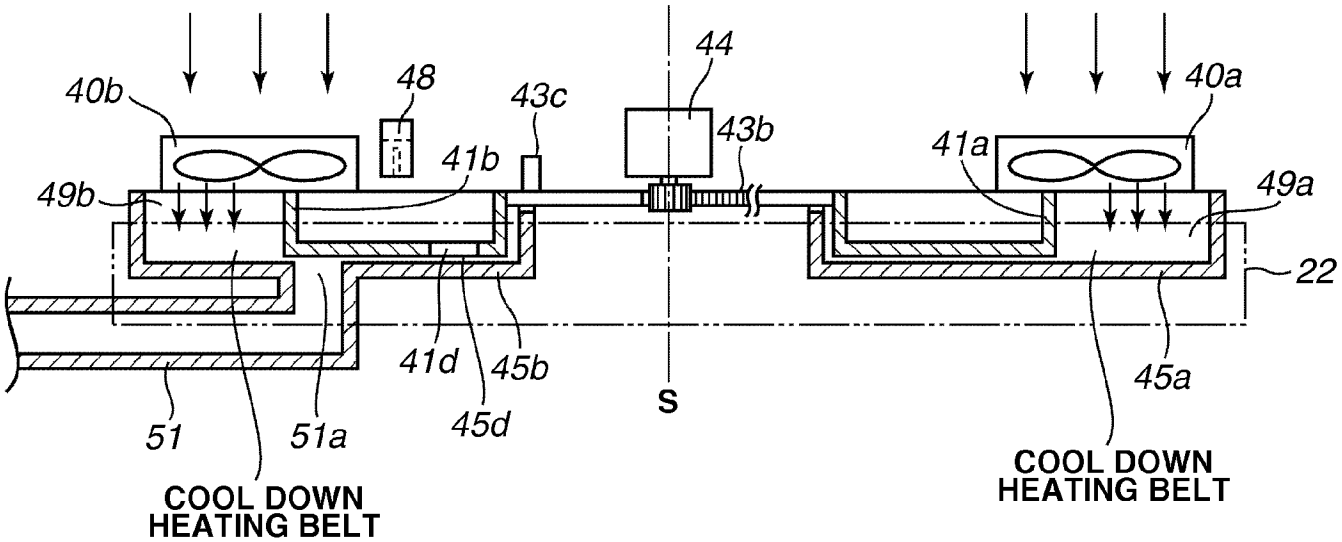
FIG. 9 is a schematic cross sectional view illustrating an operation of the shutters, when the shutters are open, according to the exemplary embodiment.

FIGS. 6 and 7 are cross sectional views illustrating the duct of the air supplying unit F-b. FIGS. 8 and 9 are cross sectional views each illustrating a shutter operation of the air supplying unit F-b and switching of air supplying paths, as seen from the A direction (as illustrated in FIGS. 6 and 7).

In FIGS. 2, 3, 6, and 7, an air supplying fan 40*a* (40*b*) is an air supplying member used for the non-sheet-passing area. An air duct 45*a* (45*b*) guides air from the air supplying fan 40*a* (40*b*) to the belt 22 to cool down the belt 22. According to the present exemplary embodiment, the air supplying fan 40*a* (40*b*) is an axial flow fan. However, the type of the fan is not limited to this, and, for example, a centrifugal fan such as a scirocco fan can be used.

A shutter 41*a* (41*b*) is disposed between the air supplying fans 40*a* (40*b*) and the belt 22 and within the air duct 45*a* (45*b*). The shutter 41*a* (41*b*) moves in response to the width of a passing recording material located in the direction perpendicular to the conveyance direction of the recording material. In other words, the shutter 41*a* (41*b*) moves to define an area where air is sent such that an area outside of the area where the recording material passes (i.e., a non-sheet-passing area) within the area of the belt 22 is cooled down. The operation is described below in detail.

The air supplying unit F-b includes the air duct 45*a* (45*b*) including the shutter 41*a* (41*b*) therein to define an area to send air. The shutter 41*a* (41*b*) is disposed in a position close to the fixing belt 22 of the fixing unit F-a, with the outer surface of the shutter 41*a* (41*b*) facing the fixing belt 22. As illustrated in FIG. 9, the air duct 45*a* (45*b*) and the shutter 41*a* (42*b*) work together to define an air supplying area 49*a* (49*b*). When air is supplied from the air supplying area 49*a* (49*b*), the air is guided along the belt 22 to cool down the area corresponding to the air supplying area 49*a* (49*b*) in the belt 22.

The shutters 41*a* and 41*b* are supported to the frame member 47 in a manner slidable in the direction perpendicular to the conveyance direction of the recording material. The shutters 41*a* and 41*b* include rack units 43*a* and 43*b* and a pinion gear 44*a* so that the shutters 41*a* and 41*b* can move with each other in the direction perpendicular to the conveyance direction of the recording material. The shutters 41*a* and 41*b* are integrally formed with the rack units 43*a* and 43*b* respectively, and the pinion gear 44*a* is engaged with both of the rack units 43*a* and 43*b*.

The pinion gear 44*a* is driven in a forward or reverse direction by a shutter motor (pulse motor) 44. The forward or reverse drive of the pinion gear 44*a* by the shutter motor 44 causes the shutters 41*a* and 41*b* to move in an interlockingly and reciprocatively with the same moving amount to be closer to or farther from each other. Accordingly, the movement of the shutter 41*a* (41*b*) determines the air supplying area 49*a* (49*b*) to the belt 22 by the air supplying member 40*a* (40*b*).

According to the present exemplary embodiment, as illustrated in FIG. 8, a state without the air supplying area 49*a* (49*b*) due to the shutter 41*a* (41*b*) completely blocking air from the air supplying fan 40*a* (40*b*) to the belt 22 is referred to as "no air supplying area state". In contrast, as illustrated in FIG. 9, the state with the shutter 41*a* (41*b*) at a position providing the maximum air supplying area 49*a* (49*b*) to the belt 22 is referred to as "maximum air supplying area state".

The shutter 41*a* (41*b*) is provided with a flag unit 43*c* for positional detection, and a detection member 48 such as a photo sensor detects a home positions of the shutter 41*a* (41*b*). The shutter 41*a* (41*b*) is controlled to move to a position appropriate for the width of a sheet passing through the apparatus, and to stop there, based on the home position detection mechanism and the number of pulses of signals transmitted to the pulse motor 44.

The air duct 45*b* is, as illustrated in FIG. 6, connected to a duct 51 as a passage for guiding air from the air supplying fan 40*b* to the pressure roller 23. The duct 51 guides air to the pressure roller 23 by bypassing the sheet conveyance path. Further, the duct 51 is provided with a large number of air emission holes located below and along the pressure roller 23 to emit air against the pressure roller 23.

As illustrated in FIGS. 8 and 9, the shutter 41*b* has an opening 41*d*. In the "no air supplying area state", the opening 41*d* of the shutter 41*b* comes to a position aligned with an opening 45*d* of the air duct 45*b*, and thereby the air from the air supplying fan 40*b* can flow into the duct 51.

In contrast, as illustrated in FIG. 9, in the "maximum air supplying area state", the opening 41*d* of the shutter 41*b* is not aligned with the air duct 45*b*, which blocks air flow to the pressure roller 23.

In other words, the more the shutters 41*a* and 41*b* move in the direction to switch from the "no air supplying area state" to the "maximum air supplying area state" to increase the air supplying area to the belt 22, the more area of the duct 45*b* the shutter 41*b* blocks. As a result, the volume of air flowing from the air supplying fans 40*a* and 40*b* to the belt 22 increases, and the volume of air flowing to the pressure roller 23 decreases.

The more the shutters 41*a* and 41*b* move in the direction to switch from the "maximum air supplying area state" to the "no air supplying area state" to decrease the air supplying area to the belt 22, the less area of the duct 45*b* the shutter 41*b* blocks. As a result, the volume of air flowing from the air supplying fans 40*a* and 40*b* to the belt 22 decreases, and the volume of air flowing to the pressure roller 23 increases.

According to the present exemplary embodiment, the amount of the duct 51 blocked by the shutter 41*b* is changed to control the balance between the air volume sent to the pressure roller 23 and the air volume sent to the belt 22. However, in the case without the shutter 41*b*, a member that can block the duct 51 and an actuator to move the member may be used to adjust the balance between the air volumes sent to the pressure roller 23 and to the belt 22.

(2-3) Controlling of Air Supply

Figure 12:
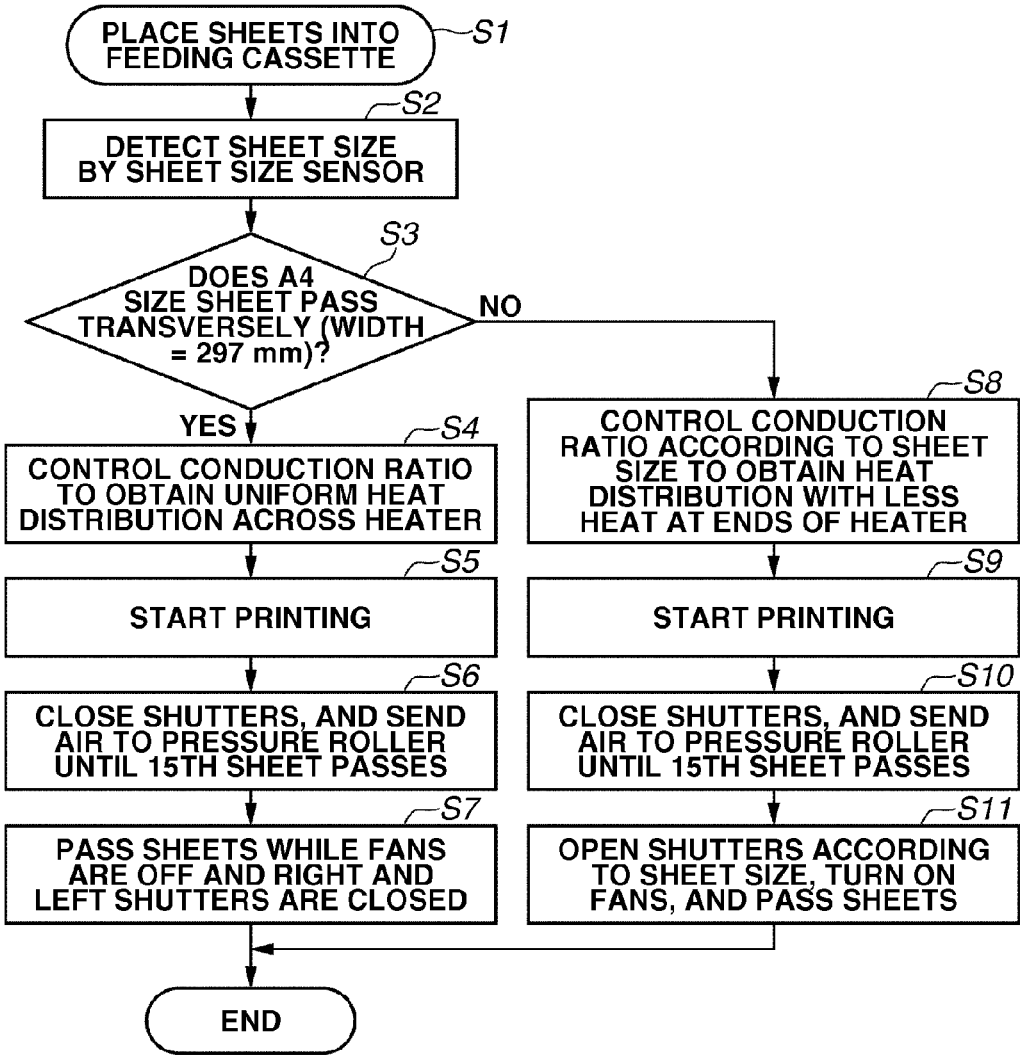
FIG. 12 is a flowchart illustrating operations of the fixing unit according to the exemplary embodiment.

Operations of the air supplying member according to the present exemplary embodiment are described below with reference to the flowchart in FIG. 12, for the case with a maximum-width recording material that can pass through the apparatus, and for the case with a smaller-width recording material having a predetermined width, respectively.

According to the present exemplary embodiment, the maximum-width recording material has a width Pa of 297 mm corresponding to the longitudinal width of an A4 size recording material, and the smaller-width recording material has a predetermined width Pb of 210 mm corresponding to the lateral width of the A4 size recording material.

When the maximum-width recording material passes through the apparatus, the shutters 41*a* and 41*b* are in the "no air supplying area state" to fix the recording material. In the case where the smaller-width recording material passes through the apparatus, a sheet width sensor (not illustrated) located in the sheet feeding cassette 1 detects the lateral width Pb of the A4 size recording material that is 210 mm, and the shutters 41*a* and 41*b* move such that the outer ends of the shutters 41*a* and 41*b* are positioned slightly outside of ends of the width Pb respectively.

FIG. 7 illustrates positions of the shutters 41*a* and 41*b*, the width Pa of the maximum-width recording material, and the width Pb of the smaller-width recording material, individually in the direction perpendicular to the conveyance direction of the recording material.

In the case where the maximum-width recording material passes through the apparatus, in step S1, a user of the apparatus places maximum-width recording materials into the sheet feeding cassette 1. In step S2, the sheet width sensor (not illustrated) detects the width of the recording material set in the cassette. Then in step S3, the sheet width sensor checks if, for example, the longitudinal width Pa of an A4 size recording material, that is 297 mm, is detected. A control circuit unit (not illustrated) controls heat distribution over the heater 20 based on detection signals of the width of the recording material. For passing of the maximum-width recording materials (YES in step S3), in step S4, the conduction ratio of the heat generating members is set so that the heater 20 generates uniform heat across its overall area. In step S5, printing starts in the state.

Figure 10:
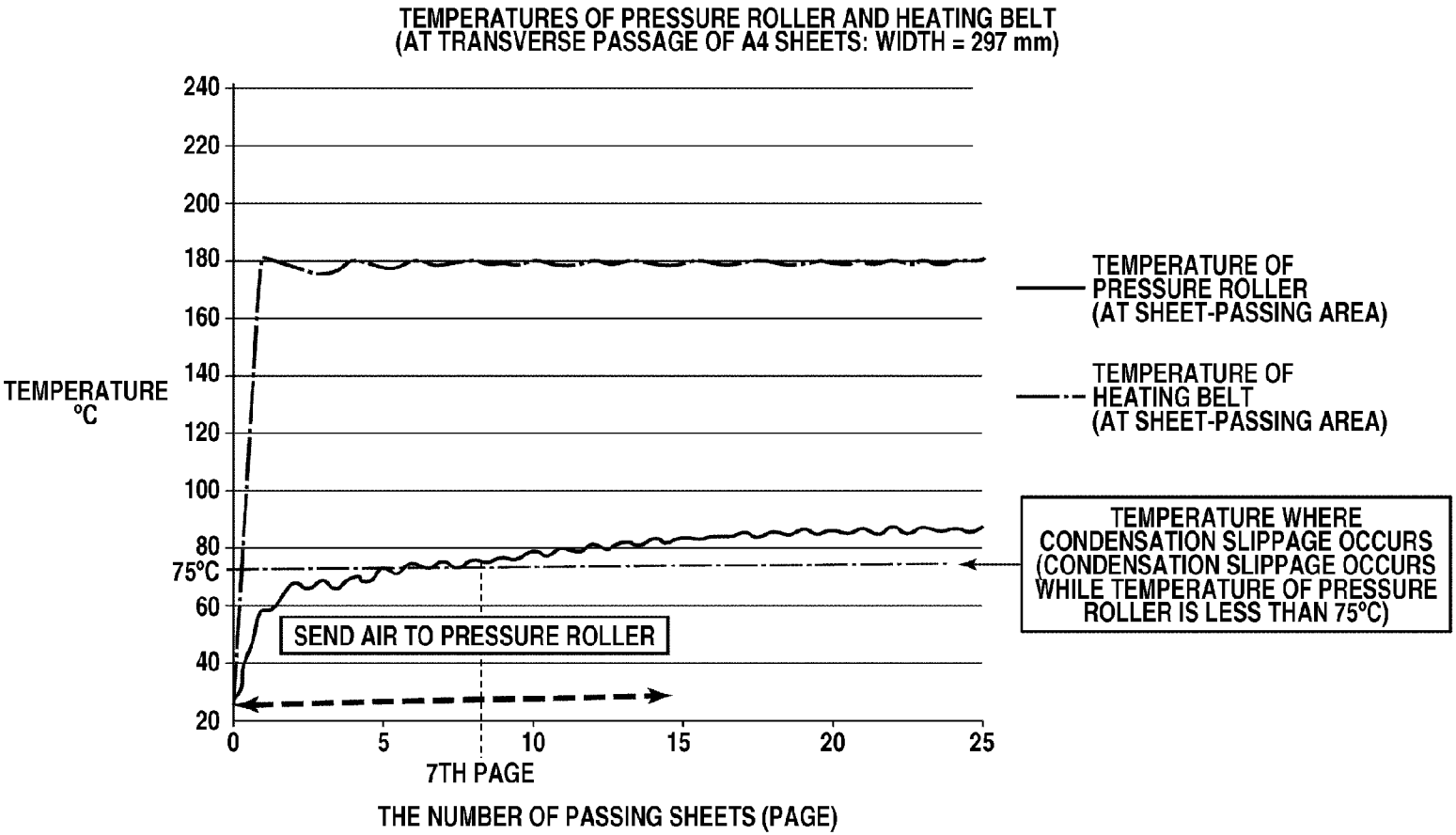
FIG. 10 illustrates temperatures of a pressure roller and a heating belt with respect to the number of sheets continuously printed, in the case where the sheets have a maximum width.

FIG. 10 is a graph illustrating the temperature of the pressure roller 23 and the highest part of the temperature of the belt 22 as a function of the number of sheets continuously printed when the apparatus of the present exemplary embodiment at a low temperature is warmed up and starts printing.

The image forming apparatus according to the present exemplary embodiment is an example which can record data of 50 sheets per minute when A4 size recording materials are transversely conveyed. According to the present exemplary embodiment, up to the eighth sheet in the continuous printing is finished from the beginning of passing of the sheets, the temperature of the pressure roller 23 has not reached 75° C., which may cause the condensation slippage described above. Accordingly, the air supplying fan 40*b* is driven while the shutters 41*a* and 41*b* are maintained in the "no air supplying area state". In the state, air is not sent to the belt 22, but only to the pressure roller 23. The air sent to the pressure roller 23 dissipates the vapor generated from the passing recording materials, preventing the slippage between the pressure roller 23 and the belt 22.

Under the conditions according to the present exemplary embodiment, about when the eighth recording material is finished in the continuous printing, the temperature of the pressure roller 23 reaches 75° C. at which no condensation slippage occurs. However, there might be variation in the point of time when the pressure roller 23 reaches 75° C. depending on the type of recording materials passing therethrough and the environment therearound. Thus, in step S6, a predetermined number of the recording materials in the continuous printing while continuing air supply to the pressure roller 23 is set to fifteen.

After the passing of the fifteenth recording material, the pressure roller 23 is heated to a temperature of 75° C., and thereby no condensation slippage occurs without air supplying to the pressure roller 23. In step S7, printing is continued while the air supply from the fans 40 is stopped.

The case where a smaller-width recording material passes through the apparatus is described. In step S1, the user of the apparatus places smaller-width recording materials into the sheet feeding cassette 1. In step S2, the sheet width sensor (not illustrated) detects the width of the recording material set in the cassette. Then in step S3, the sheet width sensor detects the materials having the width Pb of an A4 size recording material that is 210 mm. The control circuit unit controls heat distribution over the heater 20 based on detection signals of the width of the recording material. For the smaller-width recording materials Pb passing through the apparatus, in step S8, the heat distribution is controlled such that less heat is generated at both ends of the heat generating members. In step S9, printing starts in the state.

Figure 11:
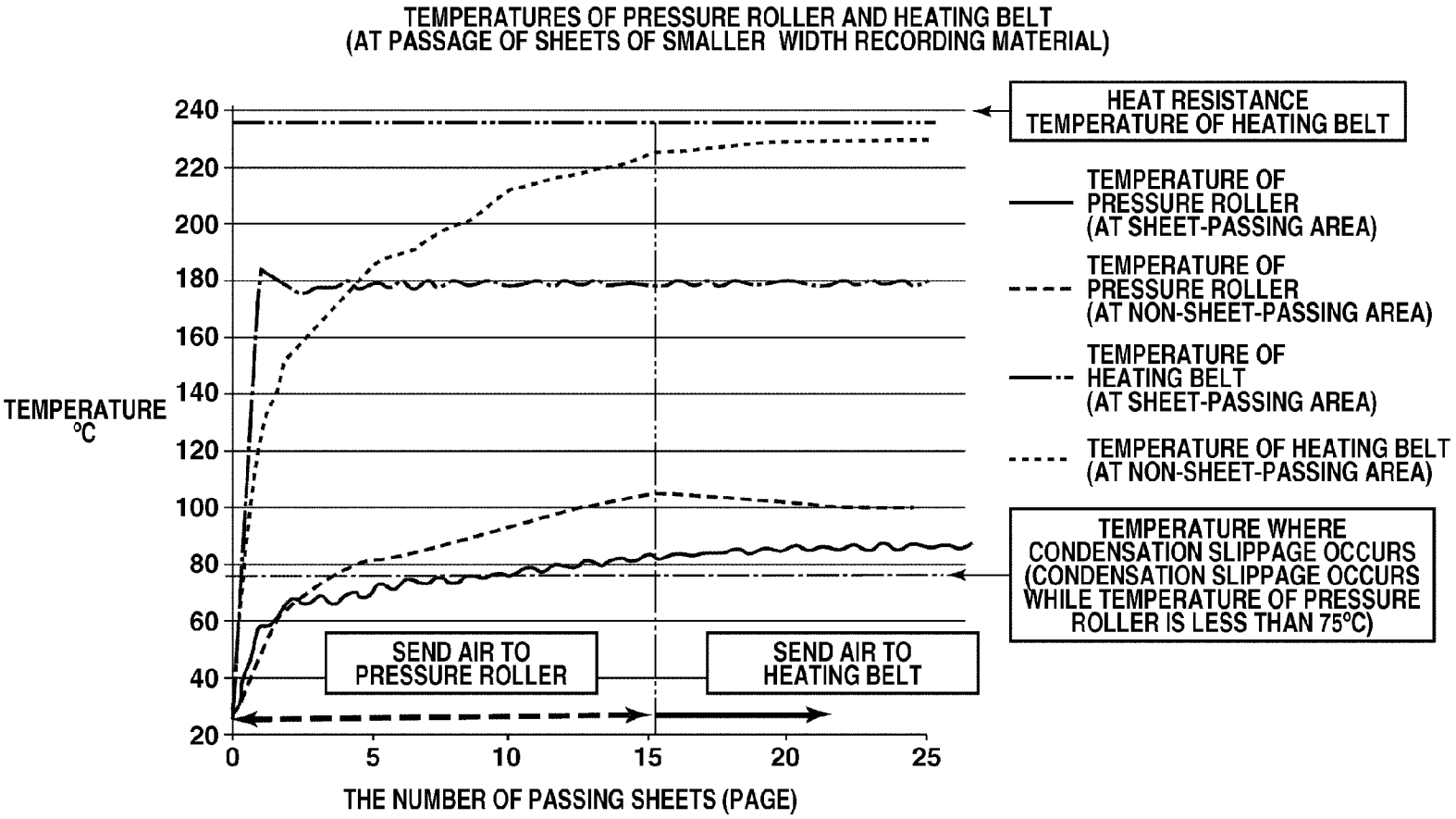
FIG. 11 illustrates temperatures of the pressure roller and the belt with respect to the number of sheets continuously printed, in the case where the sheets have a smaller width.

FIG. 11 is a graph illustrating the temperature of the pressure roller 23 and the highest part of the temperature of the belt 22 as a function of the number of sheets continuously printed when smaller-width recording materials pass through the apparatus of the present exemplary embodiment in the case where the apparatus at a low temperature is warmed up and starts printing.

In the case with the smaller-width recording material also, before passing of the eighth recording material in the continuous printing from the beginning thereof, the temperature of the pressure roller 23 has not reached 75° C., which may cause the condensation slippage. Accordingly, in step S10, the air supplying fan 40*b* is driven while the shutters 41*a* and 41*b* are maintained in the "no air supplying area state," so that air supplying to the pressure roller 23 is given priority to prevent condensation slippage.

Similarly, about at the point of time for passing of the fifteenth recording material when the pressure roller 23 is heated to a temperature of 75° C. where no condensation slippage occurs, the temperature of the belt 22 comes close to 240° C. which is its heat resistance temperature, as illustrated in FIG. 11. Thus, according to the present exemplary embodiment, the shutters 41 are moved such that a larger amount of air is sent to the belt 22 than to the pressure roller 23 when passing of the recording material reaches the predetermined number of the recording materials in the continuous printing, i.e., fifteen sheets.

After the passing of the fifteenth recording material, in step S11, the shutters 41*a* and 41*b* move to positions corresponding to the width of the recording material located in the direction perpendicular to the conveyance direction of the recording material, and air is sent to the non-sheet-passing area of the belt 22 to cool it down. Accordingly, the highest temperature of the non-sheet-passing area of the belt 22 is suppressed to about 230° C. which is lower than the heat resistance temperature thereof.

As described above, the air supplying fan for suppressing temperature rise at the non-sheet-passing area when smaller-width recording materials pass can be used as the air supplying fan for preventing condensation slippage, which achieves decreases in size and cost of the apparatus.

In addition, according to the present exemplary embodiment, the maximum width 297 mm of the maximum-width recording material and the predetermined width 210 mm of the smaller-width recording material are used as examples of widths of recording materials. However, recording materials are not limited to this and may have other widths. Any width can be accommodated by appropriately positioning the shutters 41*a* and 41*b* according to the width of the recording material located in the direction perpendicular to the conveyance direction of the recording material.

According to the present exemplary embodiment, while the shutters 41*a* and 41*b* are in the "no air supplying area state," air is sent to the pressure roller 23. However, the air supply to the pressure roller 23 can be performed at a low speed of 0.1 to 0.3 m/s for example, so that the air can be constantly sent to the pressure roller 23 to prevent both of condensation slippage at the pressure roller 23 and edge temperature rise at the belt 22.

Further, in the present exemplary embodiment, the balance of air volumes sent to the pressure roller 23 and to the belt 22 is switched based on the number of sheets printed in series. However, the balance may be switched based on the time elapsed after start of printing. For example, when smaller-width recording materials pass through the apparatus, the balance of air volumes can be switched such that air is sent only to the pressure roller 22 until a predetermined time passes after start of printing, and after the predetermined time has passed, a larger amount of air is sent to the belt 22 than to the pressure roller 23.

In addition, an environment detection member may be installed to detect the environment around the image forming apparatus, so that a timing to switch the balance of air volumes can be set based on the detection result (e.g., temperature or humidity).

For example, under an environment at a lower temperature, the switching between an air supplying only to the pressure roller 22 and an air supplying to the belt 22 more than to the pressure roller 23 can be performed at a later point of time than that in a normal environment. Whereas, the switching can be performed at an earlier point of time under an environment at a higher temperature than the normal environment.

As another measure, a temperature detection member may be provided to one of the pressure roller 23 and the belt 22 to switch the balance of air volumes to be sent. For example, a temperature detection member can be provided to the pressure roller 23, so that air is primarily sent to the pressure roller 23 when the temperature of the pressure roller 23 is less than a predetermined value, and that air is sent to the belt 22 more than the pressure roller 23 when the temperature detection member detects a temperature exceeding the predetermined value.

A case where an end temperature detection member is provided to a non-sheet-passing area of the belt 22 for smaller-width recording materials is described by way of example. While the smaller-width recording materials pass through the apparatus, when the end temperature detection member detects a temperature higher than a threshold temperature, a larger amount of air is sent to the belt 22 than to the pressure roller 23. When the end temperature detection member detects a temperature lower than the threshold temperature, air is primarily sent to the pressure roller 23.

The fixing apparatus F may be the one using any fixing method such as a heat roller method, as well as the belt heating method and the pressure rotator driving method used in the above exemplary embodiment. Otherwise, the fixing apparatus F may use an electromagnetic induction heating method.

A structure for passing recording materials based on one-side alignment provides effects similar to those described above as long as the present invention is applied to the structure.

An image heating apparatus as disclosed herein is not limited to the fixing unit as described in the above exemplary embodiment, and is applicable to an image forming apparatus including such as a gloss imparting unit configured to increase gloss of an image by heating the image fixed on a recording material.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-138597 filed Jun. 22, 2011, which is hereby incorporated by reference herein in its entirety.

What is claimed is:

1. An image forming apparatus for forming a toner image onto a recording material, comprising:

an image forming unit configured to form a toner image onto a recording material;

a fixing unit configured to fix the toner image on the recording material while conveying and heating the recording material in a nip portion, the fixing unit includes a heating member and a pressure member that forms the nip portion with the heating member;

an air supplying fan configured to cool an end portion of the heating member in a direction perpendicular to a conveyance direction of the recording material; and a shutter disposed between the air supplying fan and the heating member, wherein the image forming apparatus includes an air duct for guiding air from the air supplying fan to the pressure member.

2. The image forming apparatus according to claim 1, wherein the shutter moves in response to a width of the recording material arranged in the direction perpendicular to the conveyance direction of the recording material.

3. The image forming apparatus according to claim 1, wherein if the shutter moves to increase a volume of air guided from the air supplying fan to the end portion of the heating member, a volume of air guided to the pressure member decreases, and wherein if the shutter moves to decrease a volume of air guided from the air supplying fan to the end portion of the heating member, a volume of air guided to the pressure member increases.

4. The image forming apparatus according to claim 2, wherein if the shutter moves to increase an area for blowing air to the end portion of the heating member by the air supplying fan, the shutter blocks a larger area of an air supplying path of the air duct, and if the shutter moves to decrease the area for blowing air to the end portion of the heating member by the air supplying fan, the shutter blocks a smaller area of the air supplying path of the air duct.

5. The image forming apparatus according to claim 1, wherein if an image is formed on a recording material having a width in the direction perpendicular to the conveyance direction of the recording material that is less than a maximum width for a material conveyable through the image forming apparatus, until a predetermined period of time passes after a continuous printing starts, the shutter is positioned such that a larger volume of air is guided from the air supplying fan to the pressure member than is guided to the end portion of the heating member, and after the predetermined period of time has passed, the shutter is positioned such that a larger volume of air is guided from the air supplying fan to the end portion of the heating member than is guided to the pressure member.

6. The image forming apparatus according to claim 5, further comprising an environment detection member configured to detect an environment where the image forming apparatus is installed, and wherein the predetermined period of time is set according to a detection result by the environment detection member.

7. The image forming apparatus according to claim 1, wherein if an image is formed on a recording material having a width in the direction perpendicular to the conveyance direction of the recording material that is less than a maximum width for a material conveyable through the image forming apparatus, until a number of continuous printing of recording materials reaches a predetermined number, the shutter is positioned such that a larger volume of air is guided from the air supplying fan to the pressure member than is guided to the end portion of the heating member, and after the number of continuous printing of recording materials reaches the predetermined number, the shutter is positioned such that a larger volume of air is guided from the air supplying fan to the end portion of the heating member than is guided to the pressure member.

8. The image forming apparatus according to claim 7, further comprising an environment detection member configured to detect an environment where the image forming apparatus is installed, and wherein the predetermined number is set according to a detection result by the environment detection member.

9. The image forming apparatus according to claim 1, wherein the fixing unit includes a temperature detector configured to detect a temperature of the pressure member, and wherein if an image is formed on a recording material having a width in the direction perpendicular to the conveyance direction of the recording material that is less than a maximum width for a material conveyable through the image forming apparatus, while a temperature detected by the temperature detector is lower than a predetermined temperature, the shutter is positioned such that a larger volume of air is guided from the air supplying fan to the pressure member than is guided to the end portion of the heating member, and while a temperature detected by the temperature detector is higher than the predetermined temperature, the shutter is positioned such that a larger volume of air is guided from the air supplying fan to the end portion of the heating member than is guided to the pressure member.

10. The image forming apparatus according to claim 1, wherein the fixing unit includes an end temperature detector to detect a temperature of an end portion of the heating member in a direction perpendicular to the conveyance direction of the recording material, and wherein if an image is formed on a recording material having a width in the direction perpendicular to the conveyance direction of the recording material that is less than a maximum width for a material conveyable through the image forming apparatus, while a temperature detected by the end temperature detector is greater than a threshold temperature, the shutter is positioned such that a larger volume of air is guided from the air supplying fan to the end portion of the heating member than is guided to the pressure member, and while a temperature detected by the end temperature detector is less than the threshold temperature, the shutter is positioned such that a larger volume of air is guided from the air supplying fan to the pressure member than is guided to the end portion of the heating member.

11. The image forming apparatus according to claim 1, wherein the heating member includes a tubular belt and a heater disposed in contact with an inner surface of the belt, and wherein the pressure member forms the nip portion with the heater via the belt.

12. The image forming apparatus according to claim 1, wherein the air supplying fan is arranged at an opposite side to the pressure member across a conveyance path of the recording material.

13. The image forming apparatus according to claim 12, wherein the air duct is arranged throughout from an area where the heating member is arranged with respect to the recording material being conveyed by the nip portion, to an area where the pressure member is arranged with respect to the recording material being conveyed by the nip portion through outside a conveyance area of the recording material in the direction perpendicular to the conveyance direction of the recording material.

14. An image forming apparatus for forming a toner image onto a recording material, comprising:

an image forming unit configured to form the toner image onto the recording material;

a fixing unit configured to fix the toner image on the recording material while conveying and heating the recording material in a nip portion, the fixing unit includes a heating member and a pressure member that forms the nip portion with the heating member; and an air supplying fan configured to cool an end portion of the heating member in a direction perpendicular to a conveyance direction of the recording material, wherein the image forming apparatus includes an air duct for guiding air from the air supplying fan to the pressure member.

15. The image forming apparatus according to claim 14, wherein the air supplying fan is arranged at an opposite side to the pressure member across a conveyance path of the recording material.

16. The image forming apparatus according to claim 15, wherein the air duct is arranged throughout from an area where the heating member is arranged with respect to the recording material being conveyed by the nip portion, to an area where the pressure member is arranged with respect to the recording material being conveyed by the nip portion through outside a conveyance area of the recording material in the direction perpendicular to the conveyance direction of the recording material.

* * * * *